US005327664A

United States Patent [19]

Rothbart

[11] Patent Number: 5,327,664

[45] Date of Patent: Jul. 12, 1994

[54] POSTURAL CONTROL FOOT ORTHOTIC WITH A FOREFOOT POSTING SHIM

[75] Inventor: Brian A. Rothbart, Bellevue, Wash.

[73] Assignee: Kathleen Yerratt, Bellevue, Wash.

[21] Appl. No.: 993,671

[22] Filed: Dec. 21, 1992

Related U.S. Application Data

[63] Continuation-in-part of Ser. No. 816,674, Jan. 3, 1992, abandoned.

[51] Int. Cl.[5] ..... A61F 5/14

[52] U.S. Cl. ..... 36/174; 36/180; 36/44

[58] Field of Search ..... 36/143, 144, 172, 173, 36/174, 178, 180, 181, 43, 44, 71, 140, 88, 91, 94, 176, 182

[56] References Cited

U.S. PATENT DOCUMENTS

| | | | |
|---|---|---|---|
| 1,847,973 | 3/1932 | Morton | 36/180 |
| 1,930,889 | 10/1933 | Waksmundzka | 36/181 |
| 2,034,463 | 3/1936 | Dvlinsky | 36/180 |
| 2,051,072 | 8/1936 | Brown et al. | 36/173 |
| 2,081,474 | 5/1937 | Burns | 36/174 |
| 2,421,088 | 5/1947 | Sims | 36/174 |
| 2,589,163 | 3/1952 | Tieman | 36/71 |
| 2,628,440 | 2/1953 | Leydecker | 36/180 |
| 3,421,518 | 1/1969 | Wilder | 36/173 |
| 3,825,017 | 7/1974 | Scrima | 36/181 |
| 4,232,457 | 11/1980 | Mosher | 36/173 |
| 4,571,857 | 2/1986 | Castellanos | 36/173 |
| 4,813,159 | 3/1989 | Weiss | 36/144 |

*Primary Examiner*—Paul T. Sewell
*Assistant Examiner*—Thomas P. Hilliard
*Attorney, Agent, or Firm*—Harry M. Cross, Jr.

[57] ABSTRACT

The functional forefoot orthotic of this invention comprises a shell plate that is conformed to the sole of the foot replica, a forefoot posting shim is applied to the upper surface of the shell plate. A stabilizing heel platform may also be applied to the bottom of the shell plate. The forefoot posting shim is applied at the level of the first to third metatarsals for a varum prescription. The shape, size and thickness of the posting shim is determined by the prescription. The forefoot posting shim will have a width that will be determined by the degree of deformity in the patient's forefoot. It will be wide enough to support at least the first metatarsal and may be wide enough to support two or all three of the first-to-third metatarsals. The forefoot posting shim will accommodate the patient's varum forefoot deformity so as to provide, in combination with the shell plate replica of the patient's foot, a stable forefoot platform for the patient's foot.

19 Claims, 7 Drawing Sheets

FIG. 1A
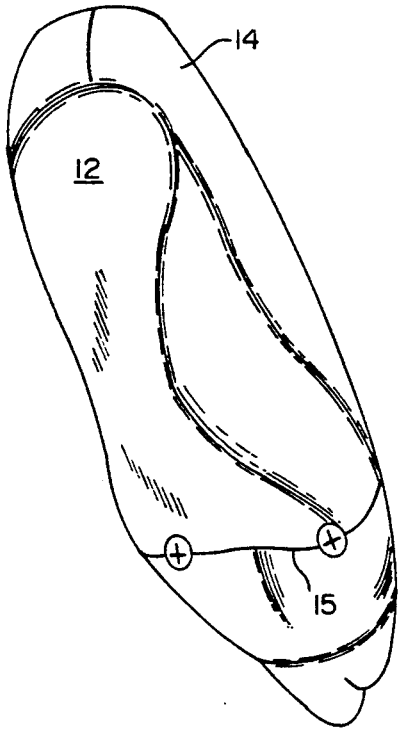
FIG. 1B
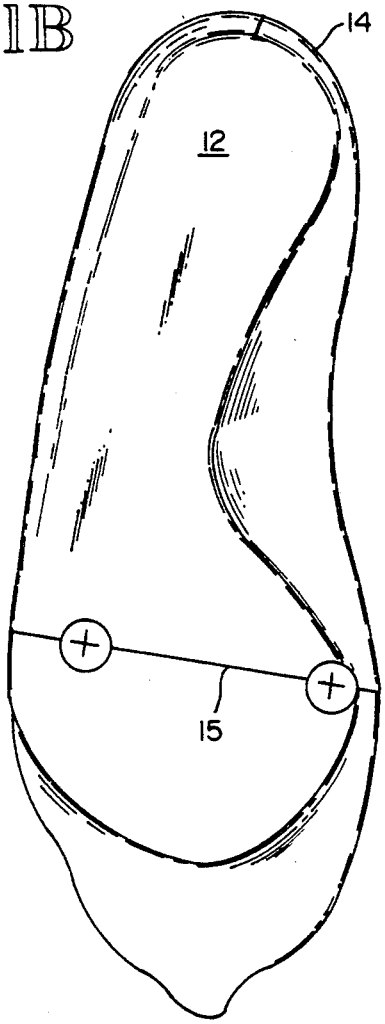
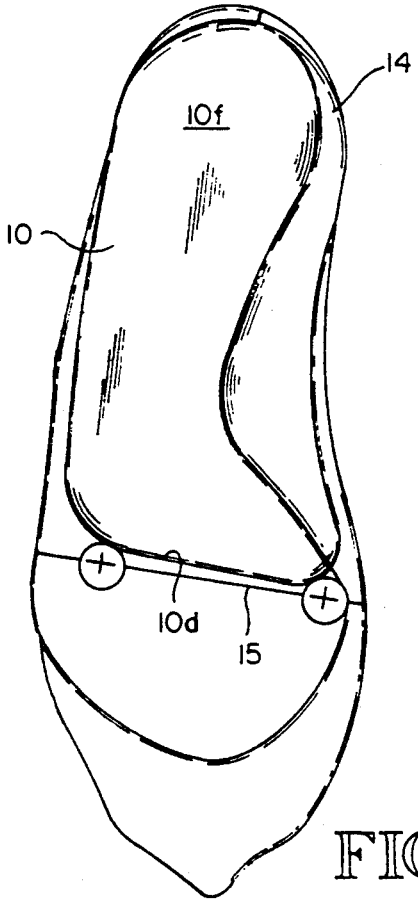
FIG. 2B
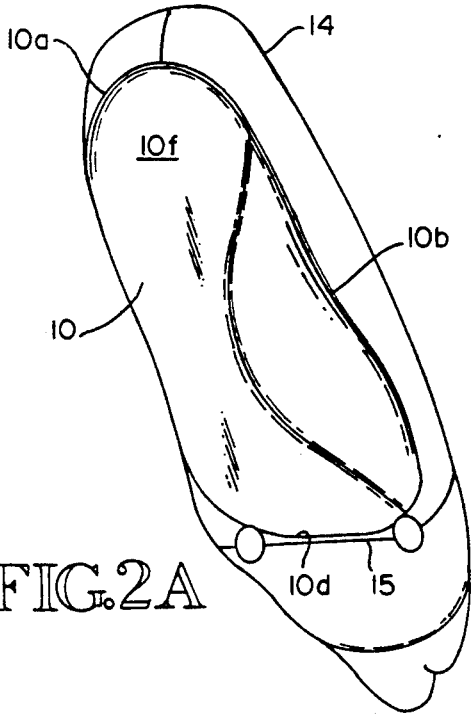
FIG. 2A

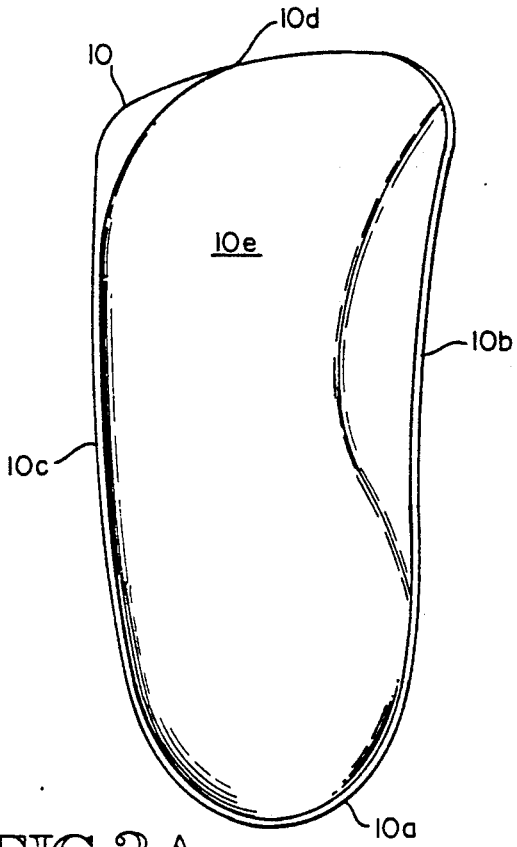
FIG. 3A
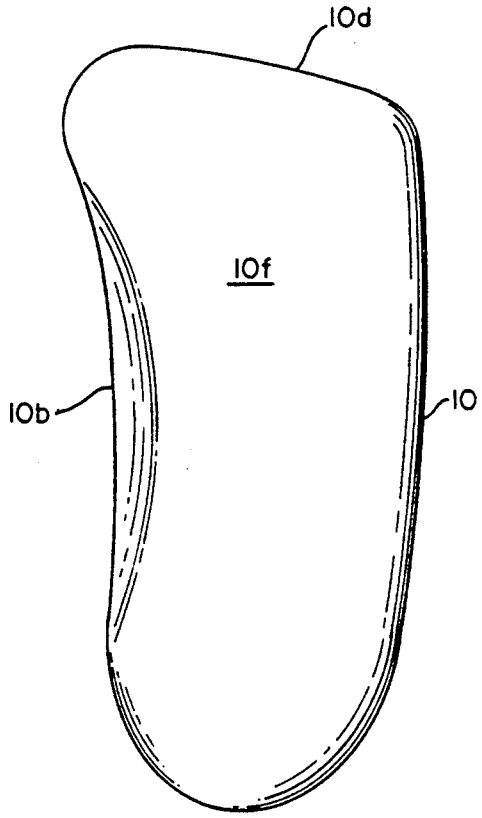
FIG. 3B
FIG. 4A
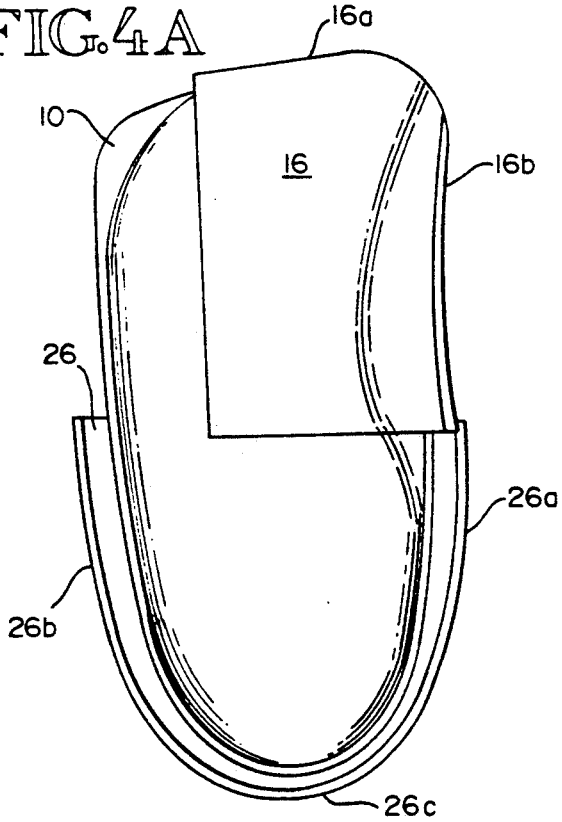
FIG. 4B
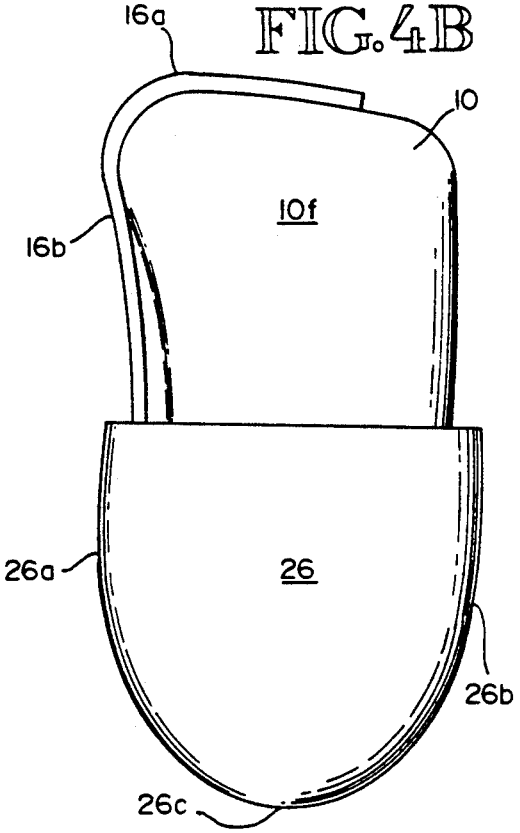

POSTURAL CONTROL FOOT ORTHOTIC WITH A FOREFOOT POSTING SHIM

RELATED APPLICATION

This application is a continuation-in-part of application Ser. No. 07/816,674 filed Jan. 3, 1992, now abandoned.

FIELD OF THE INVENTION

This invention relates to foot orthotics and, in particular, to functional foot orthotics employed to support and align the foot and to improve the functions of the foot.

BACKGROUND OF THE INVENTION

Functional control orthotics and accommodative devices known as "arch supports" are both worn in shoes, but there the similarity ends. Functional foot orthotics are distinctly different from those accommodative devices known as "arch supports." Arch supports are designed to cushion the foot. They are effective in reducing symptoms associated with flexible or fallen arches such as heel pain, plantar calluses, hammertoes and bunion deformities.

Functional control orthotics, in contrast, are prescribed orthoses that are form-fitted to a person's foot. They are designed to change the weight-bearing position of the subtalar joint of the foot. They are a medical device employed to support and align the foot and to improve the functions of the foot. They are designed to provide maximal and even distribution of the weight-bearing stresses over the entire sole of the foot.

The effect that poor foot mechanics has on the human body is now becoming better understood. As the foundation of a building supports the superstructure, the foot and ankle supports the body. If the building is unstable, it collapses. If the foot or ankle is unstable (overpronates), the joints above the foot are adversely effected. It has been said that walking is a unique activity during which the body, step-by-step, teeters on the edge of catastrophe. Man's bipedal mode of locomotion appears potentially catastrophic because only the rhythmic forward movement of the limbs keeps him from falling. The foot, being the base of support of the skeletal framework, plays an important role in gait. During early stance phase, the foot must be flexible so it can adapt to uneven ground surfaces. During late stance phase, it must be rigid to withstand the propulsive force generated by the big toe pushing off against the ground. Pronation and supination of the subtalar joint (see FIG. 10), the joint immediately below the ankle joint, gives the foot this dual capability. Pronation (FIG. 10C) of the subtalar join unlocks the foot (preparing it for heel contact), while supination (FIG. 10A) of the subtalar joint locks the foot (preparing it for toe-off).

Subtalar joint pronation has two important effects on the biomechanics of the foot: (a) it acts as a directional torque transmitter, absorbing the axial rotation of the leg and thus preventing it from entering the foot; and (b) it unlocks and prepares the forefoot for heel contact by diverging the axes of the midtarsal joint. One can easily demonstrate this shank to foot relationship by rotating the hips in a standing position. counter-clockwise rotation of the hips internally rotates the right leg and pronates the right foot (i.e. the foot rolls inward as the arch prolapses). From a causal point of view, pronation is a function of the pelvis, not the foot. The foregoing discussion presumes a normal functional relationship in which the range of pronation within the subtalar joint is dictated by pelvic rotation. However, an excessive range of foot pronation can result from structural weaknesses within the foot or shank. In such cases, the foot no longer follows the pronation pattern generated by the pelvis. This can lead to symptoms within the ankle, knee, hip and low back. A mechanical analogy is a bridge (the back) with an unstable foundation (pronated foot). In time everything above the unsound foundation shifts (soft tissue changes) and eventually collapses (joint changes). There appears to be a high correlation between excessive pronation and low back pain.

Functional orthotics are devices that control the range of subtalar joint motions and prevent excessive internal shank rotation (i.e. more that about 8 degrees of stance phase pronation). A functionally efficient orthotic must be fabricated around a neutral position foot replica (i.e. a positive foot cast). A neutral position foot replica is obtained by casting the patient in a nonweight-bearing position, holding the foot where the subtalar joint is neither supinated nor pronated, while the cast material hardens to produce a negative cast (i.e. a foot mold). Then the "positive" foot replica is cast from the "negative" mold. Using the foot replica, an orthotic is manufactured to make whatever adjustments the physician prescribes to accommodate the structural deficit.

For example, the topography presented in a forefoot varum deformity is illustrated in FIG. 11A, displaying that when the subtalar joint is held in its neutral position and the midtarsal joint is maximally dorsiflexed, the bottom (sole) of the forefoot is twisted inward (varum) relative to the posterior bisection of the heel bone (calcaneus). At midstance, forefoot varum introduces limb instability by decreasing the amount of foot-to-ground contact. In order for the medial plantar margin of the forefoot to reach the ground (a functionally stable relationship), the foot must roll excessively inward (e.g., excessively pronate).

This can be contrasted with the topography of a stable foot structure illustrated in FIG. 11B, (one which does not generate excessive foot pronation), displaying that when the subtalar joint is held in its neutral position and the midtarsal joint is maximally dorsiflexed, the bottom (sole) of the forefoot is perpendicular to the posterior bisection of the calcaneus (heel bone). This heel-to-forefoot relationship provides limb stability at midstance because the entire plantar surface of the foot contacts the ground.

An appropriate orthotic in this example as displayed in FIG. 11C eliminates medial instability of the FIG. 11A forefoot varum, by medially posting (wedging) the forefoot. This wedging increases the surface contact area between the forefoot and transverse plane by "building" the ground up to the foot; the pedal structure is now stable against the pull of gravity and excessive pronation does not occur.

Heretofore, the techniques available for manufacturing forefoot orthotics to stabilize varum and valgum deformities have been inadequate to the need. These techniques have not been capable of producing precise orthotics to meet physician's prescriptions. One could not predict whether a particular orthotic would be over, under, or exactly as prescribed. Moreover, as the effects of varum deformities are better understood, it is becoming increasingly necessary that orthotic manufacturing techniques permit incremental corrections so that the effects of the patient's varum or valgum deformities are gradually accommodated over time until a finally-prescribed orthotic structure is attained; thereby enabling the patient's body mechanics to be adjusted over a period of time.

Heretofore, orthotists have typically manufactured forefoot functional orthotics by taking a plaster cast foot replica (a "positive" cast) and modifying the bottom (sole) portion in an attempt to tailor that cast's sole portion to the prescribed forefoot posting. Then, the orthotic is grossly manufactured and then shaped to approximate the modified cast's sole portion to attain a final orthotic product that, when used by the patient, will properly align his/her subtalar joint. At best, the end product is artful inasmuch as the cast's sole-portion modification is inexact and the shaping done on the gross orthotic is also inexact. Once the foot replica's sole portion is modified, the orthotist no longer has an exact replica to use to check the accuracy of the orthotic that he is making. Consequently, the "posting", as rendered by the orthotist employing such a technique, can in actuality range, unpredictably, from several degrees too great to several degrees too little in relation to that actually prescribed by the physician. As a result, the exactness required to achieve incremental posting has not been achieved prior to the present invention.

SUMMARY OF THE INVENTION

It is a primary object of this invention to provide a functional forefoot orthotic having a structure uniquely different from orthotic configurations known heretofore. The orthotic of this invention is produced by a novel method that does not involve a modification of the patient's foot replica. Consequently, the foot replica is constantly available for alignment checking so that whatever "posting" is prescribed is accurately attained by the orthotist practicing this novel method. The functional forefoot orthotic of this invention comprises a shell plate that is conformed to the sole of the foot replica, a forefoot posting shim is applied to the upper surface of the shell plate. A stabilizing heel platform may also be applied to the bottom of the shell plate. The forefoot posting shim is applied at the level of the first to third metatarsals for a varum prescription. The shape, size and thickness of the posting shim is determined by the prescription.

The forefoot posting shim will have a width that will be determined by the degree of deformity in the patient's forefoot. It will be wide enough to support at least the first metatarsal and may be wide enough to support two or all three of the first-to-third metatarsals. The forefoot posting shim will accommodate the patient's varum forefoot deformity so as to provide, in combination with the shell plate replica of the patient's foot, a stable forefoot platform for the patient's foot.

The anterior outer edge of the forefoot posting shim (the point at which the medial and anterior sides of the shim meet for a varum prescription) has a thickness determined by the prescription. It will be the thickest part of the shim. The medial side of the shim may parallel the contour of the shell plate edge below it in the region of the forefoot. In many cases, the medial edge of the forefoot posting shim would not be skived or tapered in the region of the forefoot. In the region of the midfoot, the forefoot posting shim medial side gradually tapers back to the top surface of the shell plate adjacent the hind foot region. The inner (lateral) portion of the forefoot posting shim (toward the shim side that is nearest the longitudinal center of the shell plate) tapers down to the top surface of the shell plate to produce a natural transition from the forefoot posting shim's prescribed thickness to the top surface of the shell plate. Likewise, the posterior portion of the forefoot posting shim tapers down to the top surface of the shell plate to produce a natural transition from the forefoot posting shim's prescribed thickness to the top surface of the shell plate.

In preparation for manufacturing the functional forefoot orthotic of this invention, a foot replica is produced and the top surface thereof is leveled to produce a flat surface. The foot replica may be cast of plaster of paris from a skin-tight negative foot cast in accordance with conventional orthotist methods. A plastic plate, from which the orthotic's shell plate is to be fabricated, is pressed against the sole of the foot replica and formed thereto as exactly as possible. The shell plate, resulting from the formed plate, will have a configuration comprising a shallow heel cup and low side edges that do not come up on the side of the foot replica. The forward, or distal, end of the shell plate will end proximally adjacent to the one-five metatarsal parabola as revealed by the foot replica. Throughout the method, no modification of the sole portion of the foot replica is made. Of course, when the foot replica is made, there may exist irregularities on the sole as a consequence of the casting process; these would be carefully smoothed off so as to not alter, or modify, the replication of the bottom (sole portion) of the patient's foot. The material from which the forefoot posting shim is fashioned may be applied to the top surface of the shell plate and then that material skived and edged to produce the final forefoot posting shim configuration. Using an appropriate measuring device, such as a plurimeter, and the foot replica, the slope angle of the forefoot posting shim can be measured and checked against the prescription as the forefoot posting shim is fashioned until the exact prescription is reached.

The material from which the stabilizing heel platform is fashioned may be applied to the bottom surface of the heel portion of the shell plate. Then that material may be edged and contoured to provide a flat platform for the heel of the orthotic so that the patient will not tend to rock the orthotic within his/her shoe. If a rearfoot posting is also prescribed, the material from which the heel platform is fashioned may be contoured to include the rearfoot posting also. Any heel lift prescribed also may be added to the heel platform contour. Alternately, separate rearfoot posting and/or heel lift may be applied to the bottom of the heel platform. The definition of the functional orthotic of this invention as a "forefoot orthotic" does not exclude the provision of a rearfoot posting or a heel lift in the heel platform or as an adjunct thereto.

BRIEF DESCRIPTION OF THE DRAWINGS

FIG. 1A is a perspective view of the sole portion of a foot replica;

FIG. 1B is a bottom plan view of the sole portion of a foot replica;

FIG. 2A is a perspective view of the FIG. 1A foot replica with a shell plate configured to the sole portion of the foot replica;

FIG. 2B is a plan view of the FIG. 2A foot replica and shell plate;

FIG. 3A is a top plan view of a shell plate;

FIG. 3B is a bottom plan view of a shell plate;

FIG. 4A is a top plan view of the shell plate of FIG. 3A with forefoot posting material and heel platform material applied thereto;

FIG. 4B is a bottom plan view of the FIG. 4A assembly;

DETAILED DESCRIPTION OF THE INVENTION

A functional foot orthotic for correcting varum deformities of the foot of a patient for which the orthotic is prescribed comprises a shell plate formed to the contour of the sole portion of the patient's foot. The shell plate has posterior and anterior ends, and medial and lateral sides, the length of the shell plate being such that the anterior end will be located proximally adjacent to the one-five metatarsal parabola of the patient's foot. The shell plate has a top surface configured to replicate the sole of the patient's foot when that foot is held in a neutral, non-wight bearing position. A forefoot position shim is applied to the top surface of the shell plate to provide a forefoot varum post, the forefoot posting shim having front, medial, lateral and posterior edges, and is located at the level of the first-to-third metatarsals, with its anterior and medial peripheral edges conforming to the anterior end and medial side, respectively, of the underlying shell plate. The forefoot posting shim is constructed and arranged to extend inward from its anterior and medial peripheral edges to provide a top posting shim area sufficient to underlay at least the patient's first metatarsal, and to have its lateral and posterior portions tapered from the posting shim area back to the underlying shell plate, whereby the posting shim will accommodate the patient's varum forefoot deformity so as to provide, in combination with the shell plate, a stable forefoot platform for the patient's foot.

The functional forefoot orthotic of this invention is constructed with the forefront posting applied to the top front (medial) edge of an orthotic shell plate 10. The shell plate 10 is conformed to the sole portion 12 of a foot replica 14 of the patient for which a foot orthotic has been prescribed. Heretofore, functional orthotics of the prior art had the forefoot posting fabricated into the shape of an inner arch or placed on the bottom front edge of an orthotic shell. Both prior art orthotics required significant modification to the sole portion of a patient's foot replica in order to fabricate the required forefoot prescription. The orthotic of the present invention, in marked contrast, requires no modification of the sole portion of the foot replica, thereby dramatically simplifying the manufacturing process. Moreover, the orthotic of the present invention provides a better fit to the patient and a more precise adherence to the prescription than heretofore possible.

Figure 5A:
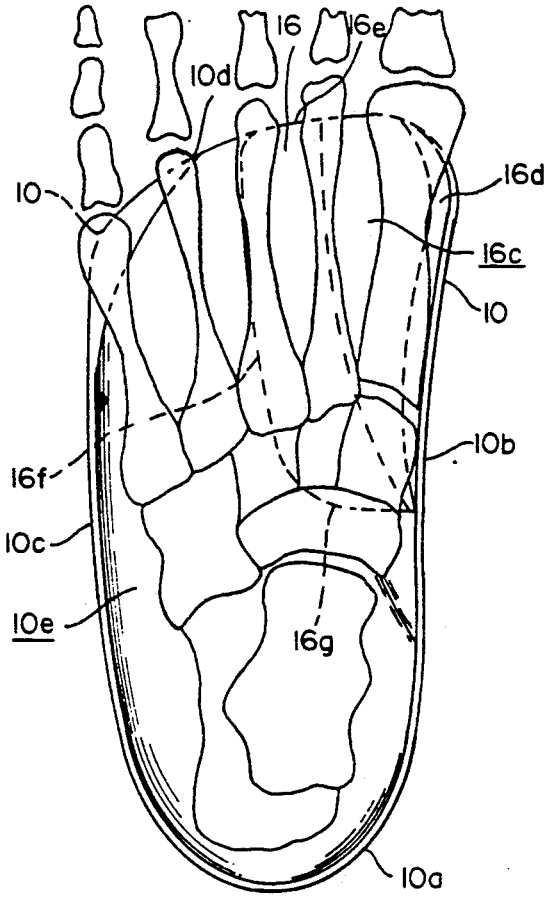
FIG. 5A is a top plan view of the FIG. 4A assembly after the forefoot posting material and the heel platform material has been configured into their final forms, with the skeletal structure of a patient's foot being superimposed over the assembly.

The foot replica 14 may be cast of plaster of paris by pouring liquid plaster in a skin-tight negative cast and allowing the plaster to set. This technique of providing a plaster foot replica is not new with this invention. Once removed from the negative cast, the foot replica is smoothed on its bottom surface 12 to remove any casting defects of imperfections. This must be done carefully because the method requires that no modification of the underside of the foot replica be made for best results. The foot replica is also sanded or otherwise machined to produce a flat, level top surface. A plastic plate is conformed to the sole 12 of the foot replica 14 to produce the shell plate 10. A preferred method for producing the shell plate 10 comprises heating the plastic plate in an oven and then vacuum-pressing the heated plastic plate onto the underside of the foot replica. The vacuum-pressing provides a quite exact conformation of the top surface of the plastic plate to the underside of the foot replica. The plastic plate is usually provided in a rectangular sheet that is slightly longer and wider than the dimensions of the shell plate 10. After the conformed plastic sheet cools, the sheet is machined, as by sanding or grinding on a bench sander or grinder, to a configuration wherein the heel cup **10*a* of the shell plate 10 is shallow and the inner and outer edges, 10*b* and 10*c*, do not come up the sides of the foot replica. The front edge of the shell plate is machined so that its front edge is about 1 mm. proximal to the one-five metatarsal parabola of the patient's foot as represented by the foot replica 14. (FIG. 5A shows this relationship to the skeletal structure of a patient's foot that is superimposed over the shell plate.) In FIGS. 1A and 1B the locations of the first and fifth metatarsal heads are marked by encircled crosses and the metatarsal parabola is approximated by line 15. As seen in FIGS. 2A and 2B, the front edge 10*d* of the shell plate is proximally adjacent to the metatarsal parabolic approximation line 15**. The top and bottom surfaces of shell plate 12 are shown in FIGS. 3A and 3B, respectively. The material from which shell plate 10 is fabricated may be one of any number of thermoplastics or thermosetting plastics. Polyethylene, polypropylenes, acrylics, polycarbonates, ABS plastics, PVC plastics, polyesters, epoxy resins, and various laminated plastics may be used. A preferred composition for the shell plate is a thermoplastic co-polymer of polypropylene with about 15% polyethylene added.

After the shell plate 10 is produced, a forefoot posting shim is applied to the top surface 10*e* of the shell plate. The drawings and this discussion assume that a varum posting is prescribed. With respect to the top surface 10*e*, a forefoot posting shim material 16 is applied to the front, medial quarter of the shell plate. Any suitable adhesive or cement may be used to apply the forefoot posting shim material 16 to the top surface 10*e*. After application, the forefoot posting shim material is machined to the adjacent peripheral edges of the underlying shell plate, as by sanding or grinding. With respect to FIG. 4A, the front and medial edges, 16*a* and 16*b*, would be machined to the underlying edges of the shell plate 10. The prescription for the forefoot varum posting will indicate to the orthotist what thickness of forefoot posting shim material is required. That thickness may be provided in one sheet or more than one sheet may be laminated up to provide the prescribed thickness.

The forefoot posting shim material may be selected from any number of cushion materials that exhibit some compressibility and memory retention. A preferred material is Nickelplast, a closed-cell polyurethane foam. This material is resistant to permanent deformation and yet is sufficiently resilient to be comfortable. Other closed or open celled synthetic foam plastics such as polyethylene and polyvinyl chloride foams, PPT foam and the like are also suitable choices.

After edging, as described in the preceding paragraph, the forefoot posting shim material is further machined to provide the final form of the forefoot posting shim shown in FIG. 5A. For the varum posting required, the front and medial portions of the material will be machined, if required to match the prescribed thickness, to the prescribed thickness along the front and medial portions so that a surface area 16*c* is provided that is co-planar with the underlaying surface of the shell plate 10. In the shell plate shown, the front medial quadrant of the shell plate's upper surface is slightly concave from rear to front and slightly concave from its medial edge toward the longitudinal center of the shell plate. Therefore, this forefoot posting shim area 16*c* is slightly concave from rear to front and slightly concave from its medial edge toward the longitudinal center of the shell plate. Consequently, this forefoot posting shim area 16*c* is of uniform thickness, that thickness being determined by the prescribed thickness of the forefoot posting shim medial edge 16*d*. Beyond this shim area, or shim surface, 16*c*, the forefoot posting shim is tapered down to the surrounding top surface 10*e* of the shell plate 10 so that a comfortable transition is made from the shim 16 to the orthotic shell 14. The anterior, lateral and posterior edges, 16*e*, 16*f* and 16*g*, of the shim 16, then, blend into the top surface 10*e* of the orthotic shell 10. The tapering of the shim's anterior edge 16*e* must be done in a fashion that does not alter the prescription; that is to say, that the tapering occurs outside of the shim surface 16*c*. The upper surface of the forefoot posting shim 16, then, conforms to, or follows, the contour of the underlying upper surface 10*e* of the orthotic shell 10 to provide a sufficient shim area 16*c* to effect the prescribed forefoot adjustment, and then the shim upper surface tapers in transition down to blend into the surrounding top surface of the orthotic shell. This shim area is longer, front to back, than it is wide and roughly terminates posteriorly beneath the location of the posterior end of the patient's medial cuneiform. The shim area is sufficiently wide that the shim area will roughly underlay and support the patient's medial three metatarsals.

The anterior medial edge 16*d* of the shim will be the thickest part of the shim because it is at this point that the prescribed posting will be located. Depending upon the varum deformity of the patient's foot, the shim area may not be coplanar with the underlying surface of the shell plate 10. The deformity may, for example, be a great as depicted in FIGS. 12–15. In these Figures, orthotics are depicted to fit a patient's right (FIGS. 12 and 14) and left (FIGS. 13 and 15) feet. In both instances, the forefoot posting shim has its greatest thickness at the medial edge thereof and this corresponds to the prescribed posting as heretofore explained. The degree of correction, however, is so great that the forefoot posting shim area appears inclined with respect to the underlying shell plate. Even in the case of such extremes, however, the forefoot posting shim extends posteriorly relatively parallel to the underlying shell plate for a short distance and then is skived down to the shell surface in the manner as heretofore described. It is worth noting that FIGS. 12–15 depict left and right foot orthotics for an actual patient, thus showing that a patient's left and right feet are not necessarily the same and that the consequent prescriptions will not be the same. Although the FIGS. 12–15 cases are extreme, it is usually the case that a patient's left and right feet will require different posting prescriptions.

Figure 5B:
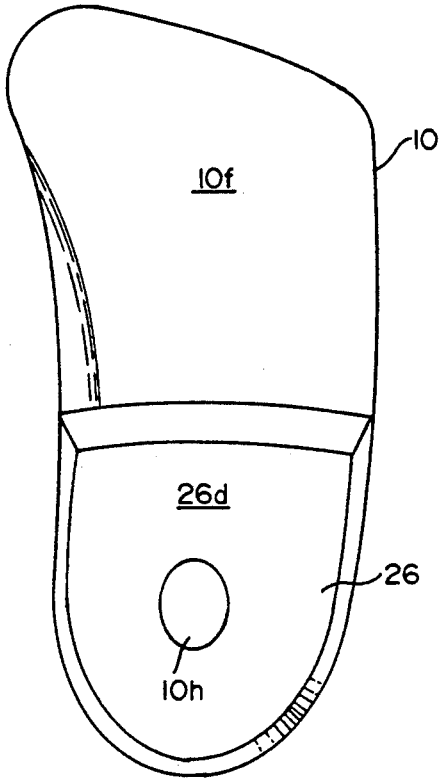
FIG. 5B is a bottom plan view of the FIG. 5A assembly.

With respect to the bottom surface 10*f* of the orthotic shell 10, a heel platform material 26 is applied to the heel portion of the shell plate. Any suitable adhesive or cement may be used to apply the platform material 26 to the bottom surface 10*f*. After application, the platform material is machined to the adjacent peripheral edges of the overlaying shell plate, as by sanding or grinding. With respect to FIG. 4B, the side and rear edges, 26*a*, 26*b* and 16*c*, would be machined to the overlaying edges of the shell plate 10. The bottom, exposed surface of the material 26 is then machined in the central region so as to provide a relatively flat (and slightly concave) bearing surface 26*d* and the peripheral edges are machined to provide a surface area for surface 26*d* that is slightly less than the width of the orthotic plate, all as shown in FIG. 5B. The surface 26*d* is machined to the point that a central area 10*h* of the overlaying shell is exposed. The end result is that the heel platform material constitutes a filler that effectively levels out the underside of the heel portion of the orthotic shell to provide a stabilizing platform so that the orthotic will not rock from side-to-side when placed in the patient's shoe. By removing an amount of heel platform material sufficient to expose the shell central area 10*h*, it is assured that the heel platform will not add unnecessary height to the orthotic.

The heel platform material may selected from any number of cushion materials that exhibit some compressibility and memory retention. A preferred material is Nickelplast, a closed-cell polyurethane foam. This material is resistant to permanent deformation and yet is sufficiently resilient to be comfortable. Other closed or open celled synthetic foam plastics such as polyethylene and polyvinyl chloride foams, PPT foam and the like are also suitable choices.

Figure 8A:
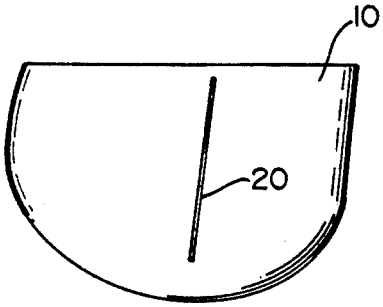
FIG. 8A is a rear end view of a foot replica resting on a flat surface prior to forefoot posting.
Figure 8B:
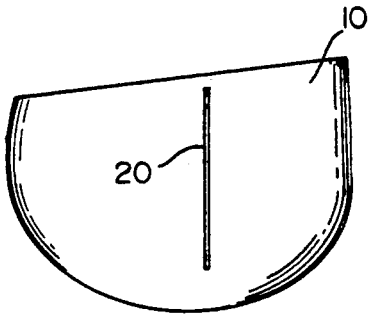
FIG. 8B is a rear end view of the FIG. 8A foot replica resting on a flat surface after forefoot posting has been achieved by installing the orthotic of this invention beneath the foot replica.
Figure 9:
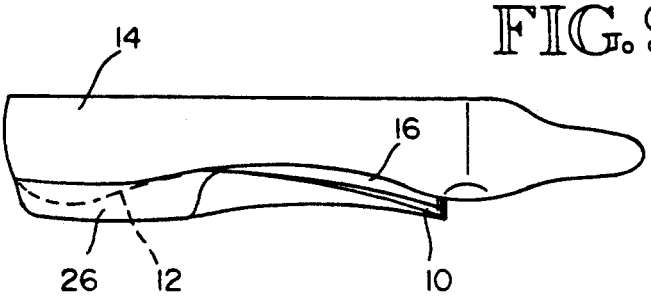
FIG. 9 is a side view of the FIG. 8A foot replica supported by the orthotic of this invention.
Figure 11C:
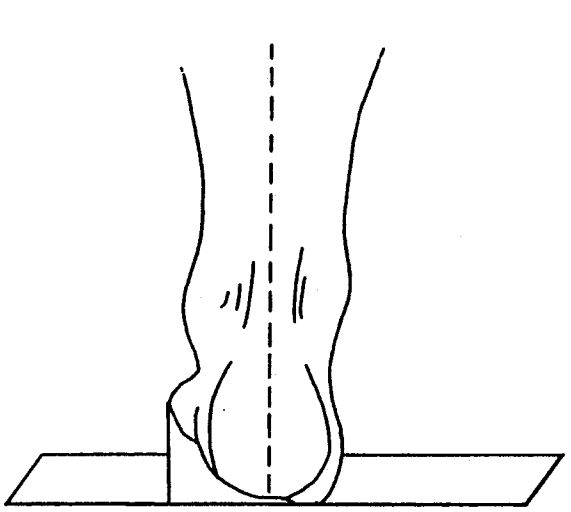
FIG. 11C shows a forefoot-wedging medial post to increase stability between the forefoot and weight bearing surface.
Figure 11B:
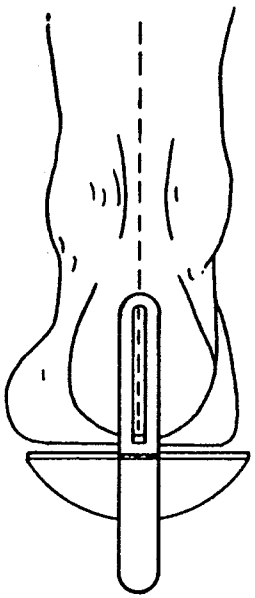
FIG. 11B shows a stable adult structure plantar (sole) aspect of the forefoot perpendicular to the posterior (rearward) bisection of the calcaneus (heel bond)
Figure 11A:
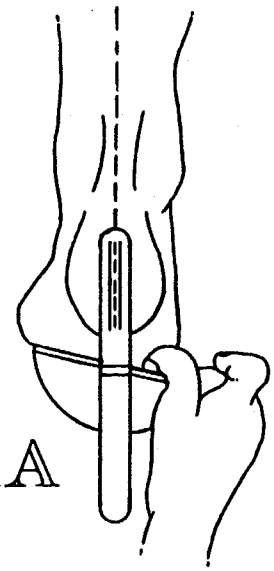
FIG. 11A shows a forefoot varum plantar (sole) aspect of the forefoot inverted relative to the posterior (rearward) bisection of the calcaneus (heel bone)
Figure 10:
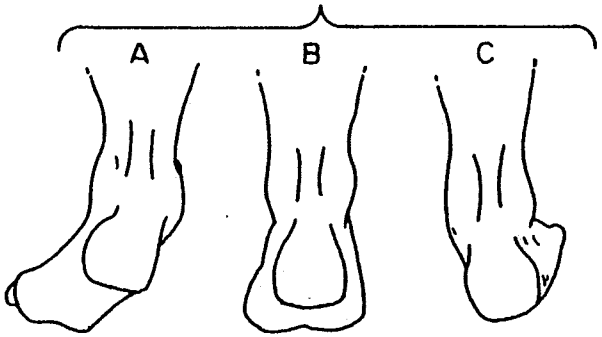
FIG. 10 shows, respectively, a supinated foot, a neutral foot and a pronated foot during late stance movement.
Figure 12:
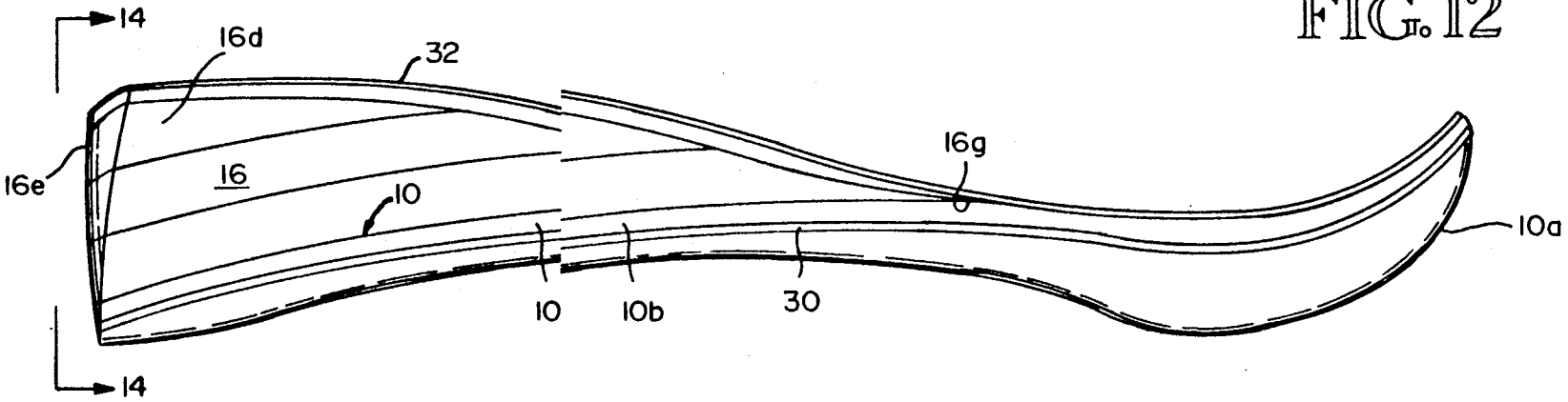
FIG. 12 is a side elevation view of an orthotic assembled in accordance with the teachings of this invention, before the addition of a stabilizing heel platform, according to a prescribed right forefoot varum posting.
Figure 13:
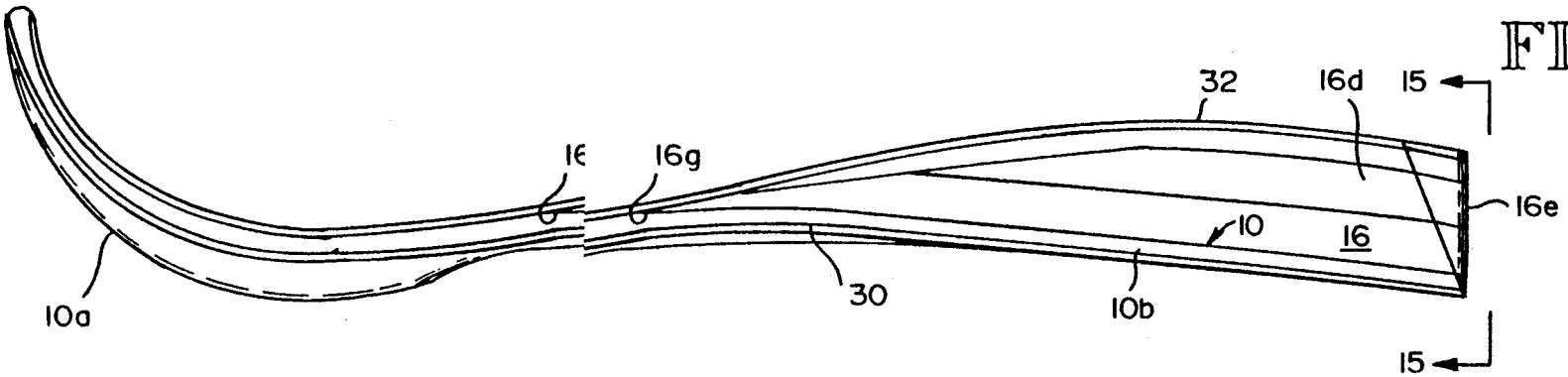
FIG. 13 is a side elevation view of an orthotic assembled in accordance with the teachings of this invention, before the addition of a stabilizing heel platform, according to a prescribed left forefoot varum posting.
Figure 14:
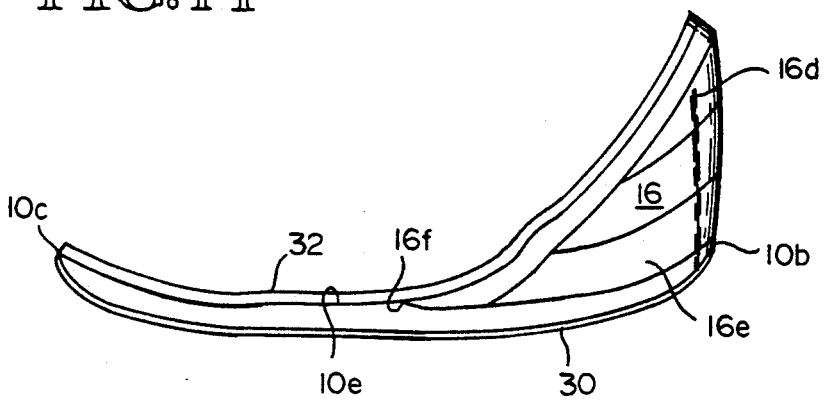
FIG. 14 is an end view along the line 14—14 of FIG. 12.
Figure 15:
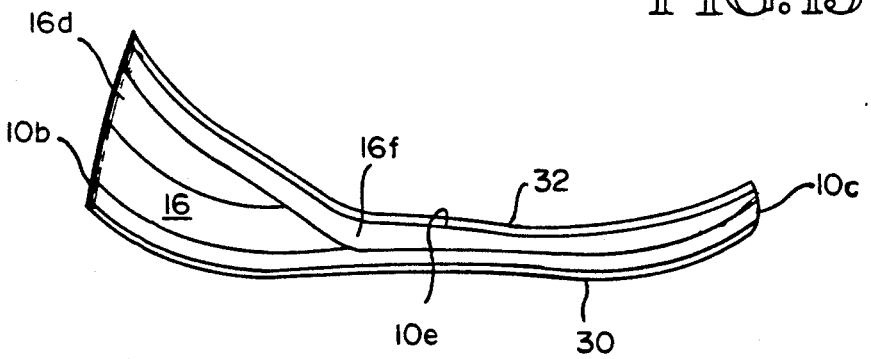
FIG. 15 is an end view along the line 15—15 of FIG. 13.

As the forefoot posting shim is fashioned, the orthotic shell and forefoot posting shim combination can be fitted to the foot replica for measurement. Using a plurimeter, the slope angle of the foot replica alone on a flat surface can be measured, and the slope angle of the foot replica—with the orthotic+forefoot posting shim beneath the foot replica—on the flat surface can be measured. The difference in the two readings represents the slope angle of the forefoot posting shim. When that slope angle matches the prescribed slope angle, the prescription is met. The result is shown in FIGS. 8A and 8B with respect to the calcaneus (heel bone) bisecting line 20, drawn on the posterior of the foot replica. FIG. 8A depicts the position of the bisecting line 20 without the orthotic and FIG. 8B depicts the adjustment effected by placing the foot replica on the orthotic. The difference in the angle of orientation between the FIGS. 8A and 8B represents the prescription angle and the degree of correction afforded by the forefoot posting shim. The resultant orthotic (shell+forefoot posting shim) conforms to the sole of the patient's foot as represented by the foot replica. Consequently, this orthotic not only will be more comfortable to the patient (since conforming to his/her foot) but also precisely matching the corrective prescription.

The extreme cases manifested in FIGS. 12–15 also show why incremental posting may often be required. A patient could not bear to have his/her foot position altered to such degrees all at once; the pain of adjustment that would appear in the patient's skeletal structure above his/her ankles would be too severe to withstand. Thus, the prescribed postings would be increased gradually over an extended period of time so that the patient's body could adjust to an interim posting correction before a greater posting correction would be introduced.

The FIGS. 12–15 cases also illustrate that the forefoot posting shim may be composed of layers of material. Each layer need not have the same thickness nor have the same elasticity/compressibility as the other layers.

It will be noted, with respect to FIG. 5A, that the forefoot posting shim is neither a transverse metatarsal arch support nor a longitudinal medial arch support. Its location with respect to these arches is such that the anterior heads of the metatarsals (at least the first, and possibly the second and third metatarsals—depending upon the degree of forefoot deformity) are elevated, to shim the forefoot to accommodate forefoot deformity, not to provide arch support. The shim diminishes from its medial edge, laterally and posteriorly in a way that does not provide transverse or longitudinal "arch support" as that term is commonly known and understood in the art; the transverse crown of the transverse metatarsal arch across the metatarsal heads (the distal ends) is not specifically supported and the longitudinal crown of the navicular and cuneiforms at the bases (proximal ends) of the metatarsals is not specifically supported. The orthotic of this invention effects a mechanical repositioning of the forefoot during movement so that the foot does not collapse in pronation, it does not support the foot's arches; arch support does not effect a mechanical repositioning of the forefoot.

If rearfoot posting is also prescribed, a rearfoot posting shim material, approximately ½ in. wide, may be applied to the appropriate bottom edge of the heel platform and tapered toward the central portion of the heel platform. In the case of a varum post, the shim would be applied to build up the medial side of the heel platform. In the case of a valgum post, the shim would be applied to build up the lateral edge of the heel platform. As described above with respect to checking the accuracy of a forefoot post, the accuracy of the shaping of the rearfoot post to attain the precise prescription may by measured with a plurimeter when the foot replica is placed on the rearfoot-posted orthotic.

Figure 6:
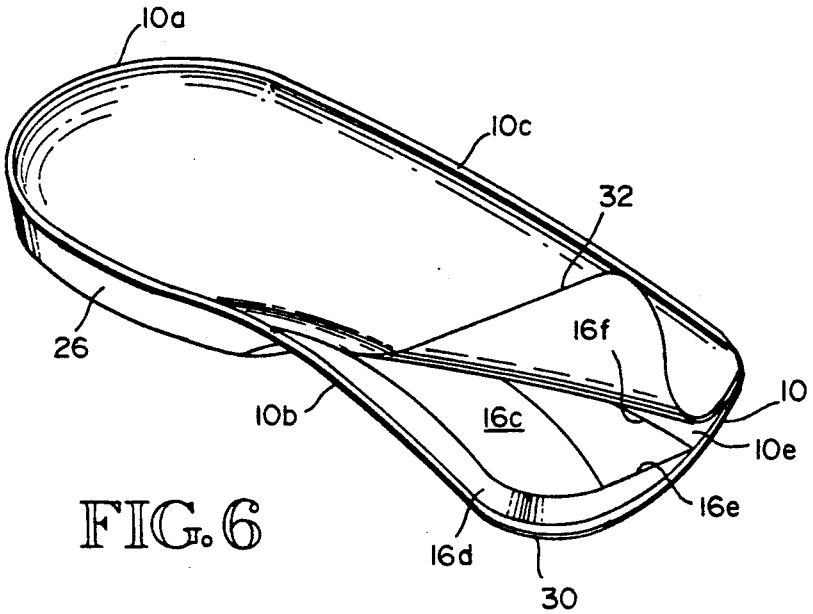
FIG. 6 is a top perspective of a completed orthotic in accordance with this invention with its top cover rolled back to reveal a portion of the forefoot posting shim.
Figure 7:
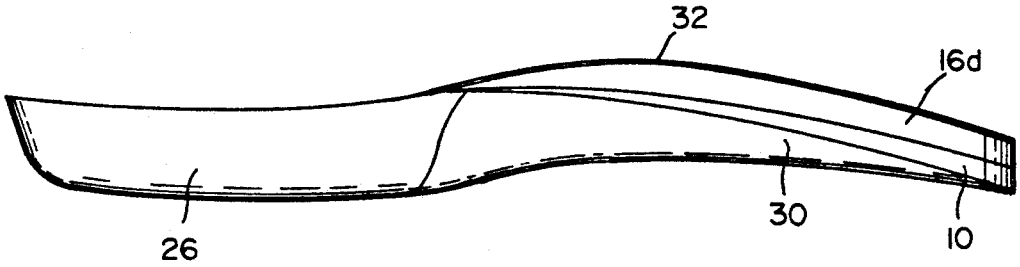
FIG. 7 is a side view of the completed orthotic in accordance with this invention.

To finish the orthotic, a bottom cover 30 (FIG. 6) is applied to the underside of the orthotic. A suitable bottom cover material would be durable and thin, such as pigskin. Also, a top cover 32 is applied to the top of the orthotic. A suitable top cover material is leather or synthetic leather. The covers are not a critical element in the orthotic or the method of manufacturing the orthotic. The top cover can contribute to the functionality of the orthotic in that an appropriately-chosen material will help prevent the patient's foot from slipping on the orthotic. Likewise, an appropriately-chosen bottom cover material will help prevent the orthotic from slipping in the patient's shoe.

In summary, the postural control orthotic described hereinabove is designed to be worn in the patient's shoe. Its purpose is to properly align the patient's subtalar (subankle) joint and reduce chronic joint pain. When the subtalar joint is properly aligned (i.e. joint margins are congruous), torsional forces generated through the weight bearing joints are reduced. If the subtalar joint is not properly aligned, superincumbent torsional forces, driven by bioengineerining principles, are increased. If chronic, these moment torques will produce changes within the ankle, knee, hip, sacral-iliac, spine, and/or temporal mandibular joints defined as osteodegenerative arthritis.

The method of manufacturing the orthotic described in the foregoing could be automated so that the various steps of manufacture could be accomplished by machines, rather than manually. For example, the precise shape of the orthotic shell required could be automatically determined by measuring means that would determine the contour of the sole portion of the foot replica and the orthotic shell could then be manufactured automatically. Moreover, the precise configurations of the posting shim and the heel platform that are required could be automatically determined in a similar manner and the posting shim and heel platform could then be manufactured automatically. Then, the three elements, the orthotic shell, the forefoot posting shim and the heel platform could be assembled and the shim and platform glued to the shell automatically. However these steps are performed, whether manually as described hereinabove or automatically by machine, the resulting orthotic can be manufactured to precisely fit the prescription.

When the orthotic of this invention is employed to accommodate the effects of mis-aligned skeletal joints, it will often be necessary that the accommodations occur in stages and over a period of time. If the patient, for example, were to be presented with the finally-prescribed corrective orthotic, the stress on his/her skeletal framework might be so great as to induce extreme discomfort in the patient. The patient's body may only permit slight corrections at one time until, over a period of time, the final correction is reached. Because the method of manufacturing the orthotic of this invention enables precisely matching the physician's prescription, the orthotic can be manufactured to provide an accurate incremental posting so that the patient's body mechanics can be adjusted over a period of time. For example, if a forefoot varum posting of 10 degrees is required, that may be accomplished by first producing an orthotic with a 5 degree posting; then, after a period of time for the body's adjustment thereto, another orthotic may be produced with a 7 degree posting; and, finally, again after a period of time for the patient's body to adjust to this posting, the final orthotic would be produced with the finally-prescribed posting of 10 degrees. The manufacturing accuracy required to accomplish such incremental posting can only be accomplished because the method of this invention employs an unaltered foot replica to 30 produce an orthotic shell that precisely conforms to the contour of the patient's sole; and because the forefoot posting, whether varum or valgum, is applied to the top surface of the orthotic shell; and because the elevated forefoot posting shim area conforms to the contour or the underlying shell and then merges back to the top surface of the shell by means of a tapered transition.

While the preferred embodiment of the invention has been described herein, variations in the design may be made. The scope of the invention, therefore, is only to be limited by the claims appended hereto.

The embodiments of the invention in which an exclusive property is claimed are defined as follows:

1. A functional foot orthotic for correcting varum deformities of the foot of a patient for which the orthotic is prescribed comprising a shell plate formed to the contour of the sole portion of the patient's foot, said shell plate having posterior and anterior ends, and medial and lateral sides, the length of the shell plate being such that the anterior end will be located proximally adjacent to the one-five metatarsal parabola of the patient's foot, and said shell plate having atop surface configured to replicate the sole of the patient's foot when that foot is held in a neutral, non-weight bearing position; and a forefoot posting shim applied to the top surface of the shell plate to provide a forefoot varum post, the forefoot posting shim having front, medial, lateral and posterior edges, and being located at the level of the first-to-third metatarsals, with its anterior and medial peripheral edges conforming to the anterior end and medial side, respectively, of the underlying shell plate; said forefoot posting shim being so constructed and arranged to extend inward from its anterior and medial peripheral edges with the thickest part of said posting shim being at the anterior medial edge thereof so as to provide top posting shim area sufficient to underlay at least the patient's first metatarsal with the greatest posting elevation being at the anterior medial edge of said orthotic, and to have its lateral and posterior portions tapered from the posting shim area back to the underlying shell plate, whereby said posting shim will accommodate the patient's varum forefoot deformity so as to provide, in combination with said shell plate, a stable forefoot platform for the patient's foot.

2. The orthotic according to claim 1 wherein said forefoot posting shim provides an elevated shim surface area conforming to the underlaying portion of the top surface of the shell plate, and provides a tapered transition from the shim surface area to the top surface of the shell plate.

3. The orthotic of claim 1 wherein said shell plate top surface is configured to provide a shallow heel cup and to extend proximally adjacent to the region of the locus of the metatarsal heads of the foot for which the orthotic is prescribed.

4. The orthotic according to claim 3 wherein said forefoot posting shim provides an elevated shim surface area conforming to the underlaying portion of the top surface of the shell plate, and provides a tapered transition from the shim surface area to the top surface of the shell plate.

5. The orthotic of claim 1 wherein said shell plate includes a bottom surface providing a heel region; and including a stabilizing heel platform applied to heel region of the shell plate.

6. The orthotic according to claim 5 wherein said forefoot posting shim provides an elevated shim surface area conforming to the underlaying portion of the top surface of the shell plate, and provides a tapered transition from the shim surface area to the top surface of the shell plate.

7. The orthotic of claim 5 wherein said shell plate top surface is configured to provide a shallow heel cup and to extend proximally adjacent to the region of the locus of the metatarsal heads of the foot for which the orthotic is prescribed.

8. The orthotic according to claim 7 wherein said forefoot posting shim provides an elevated shim surface area conforming to the underlaying portion of the top surface of the shell plate, and provides a tapered transition from the shim surface area to the top surface of the shell plate.

9. A functional foot orthotic comprising a plastic shell plate formed to the contour of the sole portion of a patient's foot for which the orthotic is prescribed by being vacuum-pressed against the sole portion of foot replica, said shell plate thereby having atop surface provided to fit the patient's foot; and a forefoot posting shim, composed of a material having compression and memory retention capabilities, applied to the top surface of the shell plate, the outer edge of the forefoot posting shim having a thickness sufficient to precisely match the prescribed posting; said forefoot posting shim having front, medial, lateral and posterior edges, and being located at the level of the first-to-third metatarsals, with its anterior and medial peripheral edges conforming to the anterior end and medial side, respectively, of the underlying shell plate; said forefoot posting shim being so constructed and arranged to extend inward from its anterior and medial peripheral edges with the thickest part of said posting shim being at the anterior medial edge thereof so as to provide a top posting shim area sufficient to underlay at least the patient's first metatarsal with the greatest posting elevation being at the anterior medial edge of said orthotic, and to have its lateral and posterior portions tapered from the posting shim area back to the underlaying shell plate, whereby said posting shim will accommodate the patient's varum forefoot deformity so as to provide, in combination with said shell plate, a stable forefoot platform for the patient's foot.

10. The orthotic according to claim 9 wherein said forefoot posting shim provides an elevated shim surface area conforming to the underlaying portion of the top surface of the shell plate, and provides a tapered transition from the shim surface area to the top surface of the shell plate.

11. The orthotic of claim 9 wherein said shell plate top surface is configured to provide a shallow heel cup and to extend proximally adjacent to the region of the locus of the metatarsal heads of the foot for which the orthotic is prescribed.

12. The orthotic according to claim 11 wherein said forefoot posting shim provides an elevated shim surface area conforming to the underlaying portion of the top surface of the shell plate, and provides a tapered transition from the shim surface area to the top surface of the shell plate.

13. The orthotic of claim 9 wherein said shell plate includes a bottom surface providing a heel region; and including a stabilizing heel platform applied to heel region of the shell plate.

14. The orthotic according to claim 13 wherein said forefoot posting shim provides an elevated shim surface area conforming to the underlaying portion of the top surface of the shell plate, and provides a tapered transition from the shim surface area to the top surface of the shell plate.

15. The orthotic of claim 13 wherein said shell plate top surface is configured to provide a shallow heel cup and to extend proximally adjacent to the region of the locus of the metatarsal heads of the foot for which the orthotic is prescribed.

16. The orthotic according to claim 15 wherein said forefoot posting shim provides an elevated shim surface area conforming to the underlaying portion of the top surface of the shell plate, and provides a tapered transition from the shim surface area to the top surface of the shell plate.

17. A functional foot orthotic for correcting varum deformities of the foot of a patient for which the orthotic is prescribed comprising a shell plate formed to the contour of the sole portion of the patient's foot, said shell plate having posterior and anterior ends, and medial and lateral sides, the length of the shell plate being such that the anterior end will be located proximally adjacent to the one-five metatarsal parabola of the patient's foot; and a forefoot posting shim applied to the top surface of the shell plate to provide a forefoot varum post, the forefoot posting shim having front, medial, lateral and posterior edges, and being located at the level of the first-to-third metatarsals, with its anterior and medial peripheral edges conforming to the anterior end and medial side, respectively, of the underlying shell plate; said forefoot posting shim being so constructed and arranged to extend inward from its anterior and medial peripheral edges with the thickest part of said posing shim being at the anterior medial edge thereof so as to provide a top posting shim area sufficient to underlay at least the patient's first metatarsal with the greatest posting elevation being at the anterior medial edge of said orthotic, and to have its lateral and posterior portions tapered from the posting shim area back to the underlying shell plate, whereby said posting shim will accommodate the patient's varum forefoot deformity so as to provide, in combination with said shell plate, a stable forefoot platform for the patient's foot.

18. The orthotic of claim 17 wherein said shell plate top surface is configured to provide a shallow heel cup and to extend proximally adjacent to the region of the locus of the metatarsal heads of the foot for which the orthotic is prescribed.

19. The orthotic according to claim 18 wherein sad forefoot posting shim provides an elevated shim surface area conforming to the underlying portion of the top surface of the shell plate, and provides a tapered transition from the shim surface area to the top surface of the shell plate.

* * * * *